US010080702B2

(12) United States Patent
Hammond et al.

(10) Patent No.: US 10,080,702 B2
(45) Date of Patent: Sep. 25, 2018

(54) PACKAGING

(71) Applicant: Multi Packaging Solutions UK Limited, Nottingham (GB)

(72) Inventors: Carol Lynn Hammond, Nottingham (GB); Nigel Davis, Nottingham (GB)

(73) Assignee: Multi Packaging Solutions UK Limited, Nottingham (GB)

( * ) Notice: Subject to any disclaimer, the term of this patent is extended or adjusted under 35 U.S.C. 154(b) by 133 days.

(21) Appl. No.: 14/919,400

(22) Filed: Oct. 21, 2015

(65) Prior Publication Data

US 2016/0120747 A1 May 5, 2016

(30) Foreign Application Priority Data

Nov. 3, 2014 (GB) ..... 1419576.2
Sep. 7, 2015 (GB) ..... 1515806.6

(51) Int. Cl.
*A61J 1/03* (2006.01)
*B65D 5/38* (2006.01)
(Continued)

(52) U.S. Cl.
CPC ..... *A61J 1/035* (2013.01); *B65D 5/38* (2013.01); *B65D 75/36* (2013.01);
(Continued)

(58) Field of Classification Search
CPC ..... A61J 1/035; B65D 5/38; B65D 75/36; B65D 83/0463; B65D 2075/361; B65D 2575/362
See application file for complete search history.

(56) References Cited

U.S. PATENT DOCUMENTS 2,971,638 A * 2/1961 Allison ..... B65D 75/36 206/467
5,150,793 A * 9/1992 Tannenbaum ..... B65D 83/0463 206/531

(Continued)

FOREIGN PATENT DOCUMENTS

GB 2451850 A 2/2009

OTHER PUBLICATIONS

EP search report for EP15190870.4 dated Mar. 7, 2016.
UK search report for GB1515806.6 dated Mar. 18, 2016.
Office action for EP15190870.4 dated Oct. 25, 2016.

*Primary Examiner* — Anthony Stashick
*Assistant Examiner* — James Way
(74) *Attorney, Agent, or Firm* — O'Shea Getz P.C.

(57) ABSTRACT

A carrier for a blister pack includes a first panel having an opening for movably receiving a blister of the blister pack, and a second panel having one or more dispensing openings aligned with the first panel opening. The first panel and the second panel slidably receive the blister pack there between. The carrier includes a blocking tab between the first and second panels that is selectively moveable between a blocking position and a dispensing position. When the blocking tab is in its blocking position it prevents movement of the blister in the first panel opening into alignment with a dispensing opening, thereby preventing dispensing of the blister's contents through the dispensing opening. When the blocking tab is in the dispensing position, it permits the blister to be moved into alignment with a dispensing opening for dispensing the blister's contents. The blocking tab is connected to a free edge of one of the first and second panels about a fold line, and one of the first and second panels of the blister pack carrier is connected to a panel of a slider.

20 Claims, 11 Drawing Sheets

(51) Int. Cl.
*B65D 83/04* (2006.01)
*B65D 75/36* (2006.01)

(52) U.S. Cl.
CPC .... *B65D 83/0463* (2013.01); *B65D 2075/361* (2013.01); *B65D 2575/362* (2013.01)

(56) References Cited

U.S. PATENT DOCUMENTS 5,915,559 A * 6/1999 Hulick ..... B65D 75/327 206/468
6,394,275 B1 * 5/2002 Paliotta ..... B65D 83/0463 206/468
6,491,211 B1 12/2002 Evans et al.
6,675,972 B2 * 1/2004 Patterson ..... B65D 75/327 206/468
6,708,825 B2 * 3/2004 Filion ..... B65D 75/327 206/531
6,848,580 B2 * 2/2005 Paliotta ..... B65D 75/327 206/531
7,201,274 B2 * 4/2007 Paliotta ..... B65D 75/327 206/531
7,464,818 B2 12/2008 Gherdan et al.
7,929,660 B2 * 4/2011 Ullberg ..... A61B 6/0414 378/208
2003/0213721 A1 11/2003 Jones
2007/0084747 A1 * 4/2007 Gherdan ..... B65D 83/0463 206/531
2007/0235367 A1 * 10/2007 Initini ..... A61J 1/035 206/531
2009/0038982 A1 2/2009 Doucet et al.
2010/0243507 A1 * 9/2010 Gelardi ..... B65D 73/0085 206/531
2016/0120745 A1 * 5/2016 Hammond ..... A61J 1/035 206/531
2016/0122106 A1 * 5/2016 Hammond ..... A61J 1/035 206/468

* cited by examiner

PACKAGING

This application is entitled to the benefit of, and incorporates by reference essential subject matter disclosed in United Kingdom Application No. 1419576.2 filed on Nov. 3, 2014 and United Kingdom Application No. 1515806.6 filed on Sep. 7, 2015.

BACKGROUND OF THE INVENTION

1. Technical Field

The present invention relates to child resistant packaging. The present invention is, in particular, although not exclusively, directed to packaging for pharmaceutical products. The packaging is made of a foldable sheet material, such as cardboard, paperboard, or the like.

2. Background Information

The Applicant has realized that there is a need for improved safety packaging that prevents, or at least makes more difficult, the dispensing of the contents of the packaging by children.

Blister packs are well known, particularly for pharmaceutical products. The pack comprises one or more "blisters" which hold capsules, tablets or other items, and whose face is sealed by a layer of foil or other film. The blister contents are dispensed by the user pressing down on the blister, thereby pushing the contents out through the sealing layer.

The present invention seeks to provide an improved package of this type, which, in preferred embodiments at least, may be manufactured in a more efficient manner.

BRIEF SUMMARY OF THE INVENTION

In accordance with a first aspect of the invention there is provided a carrier for a blister pack, the carrier comprising: a first panel having an opening for movably receiving a blister of said blister pack; a second panel having one or more dispensing openings aligned with said first panel opening, the first panel and the second panel slidably receiving the blister pack there between; and a blocking member selectively moveable between a blocking position and a dispensing position, said blocking member in its blocking position preventing movement of said blister in said first panel opening into alignment with a said dispensing opening, thereby preventing dispensing of the blister's contents through the dispensing opening, and in said dispensing position permitting said blister to be moved into alignment with a said dispensing opening for dispensing the blister's contents. The blocking member is connected to a free edge of one of the first and second panels about a fold line, and wherein one of the first and second panels of the blister pack carrier is connected to a panel of a slider.

In accordance with the invention, a blocking member is connected to a free edge of one of the first and second panels of the blister pack carrier. As one of the first and second panels of the carrier is connected to a panel of a slider, connection of the blocking member to a free edge of one of the first and second panels in this way enables the carrier to be more efficiently manufactured, without the presence of the slider interfering with folding of the blocking member into position.

Before dispensing a capsule etc. from a blister, the blocking member must first be moved to a dispensing position to allow the blister to be moved into alignment with a dispensing opening. This will at least make it more difficult for a child to dispense the blister's contents. The blister pack carrier may incorporate any of the features described in GB 2451850A.

The blocking member is preferably sandwiched between the first and second panels of the blister pack carrier. The blocking member may be secured to whichever of the first or second panels it is connected to about the foldline e.g. using adhesive. The one of the first and second panels to which the blocking member is connected may then be attached to the other of the first and second panels e.g. using adhesive to sandwich the blocking member between the first and second panels.

The blocking member has a part, e.g. an edge, which, in the blocking position, cooperates with the blister pack to prevent its movement. The blocking member may be a tab. The tab may be generally triangular or trapezoidal in shape, with its wider end adjacent an end of the blister pack carrier. The blocking member, or at least the portion thereof having the blocking part, may be located centrally between the side edges of the blister pack carrier.

In some embodiments the blocking member is a tab which is pushed out of the plane of the package i.e. blister pack carrier to allow the blister pack to move.

The blocking member may be connected to a free side edge or a free end edge of the first or second panel of the blister pack carrier. This will depend upon the positions of the first and second panels relative to one another, and of the slider relative to a panel of the blister pack carrier. It has been found that connection to an end edge may facilitate manufacture, enabling the blocking member to be more easily handled to fold it into position. Such arrangements may also enable the blocking member to be provided as part of a blocking device that may be more readily handled e.g. which extends along a greater length of the free edge than would be possible using arrangements in which connection is to the side edge. However, connection to a side edge may equally be advantageous in certain situations and/or configurations.

The blocking member is connected to a free edge of a panel of the blister pack carrier about a fold line. The blocking member may be connected to the free edge via a connecting portion. Such arrangements are particularly suitable where the free edge is a side edge of the first or second panel. The connecting portion may be integral with the blocking member. In some embodiments the carrier comprises a blocking device connected to the free edge about a fold line, the blocking device comprising the blocking member and a connecting portion connecting the blocking member to the free edge. The connecting portion may be an elongate connecting portion. The connecting portion may be in the form of a limb. The blocking device is preferably a single piece blocking device. In embodiments the blocking device may have a proximal end, being the end connected to the free edge of the panel of the carrier, and an opposite distal end, with the blocking member being at a distal end of the blocking device. However, it is envisaged that the blocking device may extend beyond the blocking member, such that the blocking member is located between the proximal and distal ends of the blocking device.

In other embodiments, where the blocking member is connected to an end edge of one of the first and second panels of the blister pack carrier, the blocking member is in the form of a tab connected to the end edge e.g. to a central portion thereof. In some embodiments the blister pack carrier comprises a blocking device connected to the end edge of one of the first and second panels thereof about a foldline. The blocking device may be in the form of a blocking panel. The device is preferably a single piece device. The blocking device may extend along any portion of a length of the end edge, but in some preferred embodiments extends along at least 50%, or at least 70% or at least 90% of the length of the end edge. Preferably the blocking device extends along the entire length of the end edge. The blocking device preferably has a proximal edge connected to the end edge of the first or second panel along a foldline, and a distal edge defining a blocking member e.g. blocking tab. The distal edge may define a central peak providing the blocking member e.g. tab. In some embodiments the distal edge defines a central peak providing the blocking member e.g. tab between two valleys, with a further peak being provided on either side of the valleys toward the side edges of the panel, the blocking member being provided by the central peak. In these preferred embodiments the blocking device is adhesively attached to the first or second panel by means of adhesive applied to each of the central and further peaks. The further peaks are preferably of the same height as the central peak for ease of manufacture. These arrangements may therefore provide the ability to more securely fasten the blocking member to its respective blister pack panel by means of the adhesive applied to the further peaks of the blocking device, while the valleys enable the blocking member to flex to enable it to be moved out of the plane to permit sliding of the blister pack in use. However, the provision of the valleys on either side of a central peak, and further peaks on either side of the valleys, is only optional.

The first and second panels of the blister pack carrier may be connected to one another in a side by side or end to end configuration. The panels may be separately formed and connected to one another, or may be integrally formed. Preferably the first and second panels are connected to one another along a fold line. Thus adjacent side edges or end edges of the panels may be connected to one another about a foldline. In embodiments in which the first and second panels are connected to one another end to end, the blocking member is preferably connected to a side edge of one of the first and second panels. The blocking member may be connected to a side edge of the first or second panel of the blister pack carrier at an end of the first or the second panel which is connected to the other one of the first and second panels about the fold line. In embodiments in which the first and second panels are connected to one another side by side, the blocking member is preferably connected to an end edge of one of the first and second panels.

In accordance with the invention, one of the first and second panels of the blister pack carrier is connected to a panel of a slider. In some embodiments the panel of the blister pack carrier is the second panel. Preferably the panel of the blister pack carrier is connected to the slider at an end of the slider. The panel of the slider may be any panel of the slider. The blister pack carrier may be connected to an end or facing panel of the slider. The panel of the blister pack carrier may be connected to any edge of the panel of the slider, although is preferably connected to an end edge thereof.

The slider and the blocking member may be connected to the same one of the first or second panels of the blister pack carrier. The slider is preferably connected to an end of the blister pack carrier opposite to an end at which the blocking member is provided. Thus the blister pack carrier may, in its in use configuration, define a free end and an end connected to the slider, with the blocking member being provided at the free end of the carrier. In some embodiments, the blocking member is connected to one end of said one of the first and second panels of the blister pack carrier, and an opposed end of the panel of the blister pack carrier is connected to the slider i.e. to an end thereof. It will be appreciated that connection of the blister pack carrier to an end of the slider may be used in conjunction with the blocking member being connected to a side edge or end edge of a panel of the carrier and/or the panels of the carrier being in side by side or end to end configuration.

The slider may be separately formed from and attached to the blister pack carrier i.e. to a panel thereof. However, preferably the slider is integral with the blister pack carrier. The blister pack carrier and the slider may be formed from portions of a single blank defining the slider and the blister pack carrier.

The slider may comprise at least one facing panel and at least one sidewall. In some preferred embodiments the slider comprises a pair of sidewalls and at least one facing panel connecting the sidewalls. The slider may comprise a single facing panel. In some embodiments the slider comprises an end panel or wall having a first edge connected to a facing panel of the slider along a foldline, and having an opposed second edge connected to a panel of the blister pack carrier along a foldline, the first and second edges connected by side edges of the end panel or wall.

The panel of the blister pack carrier is preferably connected to the panel of the slider about a foldline. The blister pack may be configured to be foldable about the fold line into a storage position relative to the slider. The blister pack carrier is preferably hingedly connected to the slider. In some embodiments the blister pack carrier is movable relative to a facing panel of the slider about a foldline connecting the carrier to the slider between a storage configuration, in which a surface of the carrier faces the facing panel, and an open configuration for permitting access to the content of the blister pack. The surface of the carrier that faces the facing panel may be a surface of the first panel thereof. The open configuration may be a configuration in which the blister pack carrier defines an angle with respect to a facing panel of the slider of at least 90 degrees, and preferably at least 135 degrees, or 180 degrees. The user may thus unfold the blister pack carrier from the slider to access the content of the blister pack, in a similar manner to opening a wallet.

The slider is configured to be slidably received within a container. The present invention extends to a container comprising the slider having the blister pack carrier connected thereto slidably mounted within the container, and to a package comprising such a container and the slider. The container may be of any suitable form. The container may comprise a pair of side panels, and at least one, and preferably a pair of facing panels. The slider may be slidably mounted with respect to a container having an open end and a closed end to enable the slider to be moved between a first position relative to the container, in which the slider is located at least partially within the container for preventing access to the blister pack carrier, and a second position relative to the container in which at least a portion of the slider extends through an open end of the container for permitting access to the blister pack carrier.

The slider (and container where provided) are preferably made of a foldable sheet material, such as cardboard, paperboard or the like.

Preferably the slider is configured to be lockably received in a container in use to prevent complete separation between the slider and the container. Preferably the slider further comprises a retaining flap for cooperating with a container within which the slider is slidably received in use to prevent complete separation of the slider and the container. In preferred embodiments the retaining flap is provided at an opposite end of the slider to the end which is connected to the panel of the blister pack carrier.

It will be seen that the panels of the blister pack carrier, the blocking member and the slider may be connected to one another in various configurations. In one set of embodiments the blocking member is connected to a side edge of one of the first and second panels of the blister pack carrier (optionally the first panel) about a fold line, and that one of the first and second panels of the blister pack is connected to one end of the other of the first and second panels about a foldline, said other of the first and second panels being connected at an opposed end to an end of the slider. In another set of embodiments, the blocking member is connected to an end edge of one of the first and second panels of the blister pack carrier (optionally the second panel) about a fold line, said one of the first and second side panels being connected at its opposed end to the slider, the first and second panels of the blister pack carrier being connected to one another in a side by side configuration. Of course, these embodiments are only exemplary of certain configurations that have been found to be particularly useful.

The blister pack carrier of the present invention may include any of the feature described in GB 2451850A, to the extent that they are compatible with the embodiments of the present invention.

The panel of the blister pack carrier to which the blocking member is connected is preferably provided with a tab portion defined by a cut line or line of weakness. The tab portion is positioned such as to be generally aligned with an end portion of said blocking member e.g. blocking tab when the blocking member is folded into position between the first and second panels. The end portion of the blocking member may be an opposite end to a wider end where the blocking member is triangular or trapezoidal in shape. The other of the first and second panels is preferably further provided with a cut line or line of weakness which is also generally aligned with an end portion of the blocking member e.g. tab when the blocking member is folded into position between the first and second panels. In embodiments in which the blocking member is a blocking tab which is pushed out of the plane of the package to allow the blister pack to move, the first or second panel is formed with a tab portion which is generally aligned with a blocking tab of the blocking member and which is depressible along with the blocking tab so as to allow the blister pack to slide up over an external surface of the tab portion. The other of the first panel or second panel is preferably provided with one or more cuts or lines of weakness which allow the tab to be pushed through that panel.

Preferably the or each first panel opening is an elongate slot. This allows the slot to closely receive and guide the blister of the blister pack.

The opening or slot within the first panel may be long enough to accommodate a strip of multiple blisters. However, in preferred embodiments it is only sufficiently long to accommodate a single blister. In these embodiments, each blister has its individual opening. It has been found that such arrangements enhance child resistance, as a shorter opening e.g. slot reduces the ability of a child to try to remove the blister pack through the first panel of the blister pack carrier. As most blister packs are formed with a plurality of rows of blisters, in some embodiments of the invention, a plurality of parallel slots are provided in the first panel, and a plurality of aligned rows of dispensing openings provided in the second panel. In preferred embodiments in which each opening in the first panel is of a length to accommodate only a single blister, an array of openings is preferably provided in the first panel. An array of aligned dispensing openings e.g. slots may then be provided in the second panel. Of course, the first panel may include openings or slots which are of a length which accommodates multiple blisters, but which are not long enough to accommodate an entire strip of blisters.

The or each dispensing opening of the second panel is preferably provided with a removable cover. This provides enhanced child resistance, as the child may be prevented from seeing the blister pack until the cover is removed. The cover may be defined by one or more line of weakness e.g. perforations around the opening. In some preferred embodiments each removable cover is defined by a plurality of removable segments, such as a pair of segments. For example, each segment may be in the shape of a semi-circle or ellipse. The shape of the segments may be selected as desired, and may depend upon the shape of the removable cover to be defined, which in turn may depend upon the shape of the content of the blisters e.g. tablets, pills etc. The provision of segmented removable covers may provide an additional level of child resistance, with the child needing to remove multiple segments to provide a dispensing opening. The second panel is preferably provided with a plurality of dispensing openings corresponding in number to the number of blisters provided in the blister pack. Thus when the blister pack is moved to a dispensing position, one or other of the blisters will be in alignment with a dispensing opening.

Preferably the blister pack is mounted for sliding movement along a straight line relative to the carrier. Preferably, therefore, the first panel slot or slots is or are straight.

The first panel slot may be configured so to align a blister with the relevant dispensing opening when the or an end-most blister in a blister row is located against one end of the slot. In some embodiments, therefore, the end of the slot may be arcuate for engagement with an arcuate blister. However, this is not essential, and it may in fact be desirable to require the blister to be aligned manually with the dispensing opening, thereby making it even more difficult for a child to dispense the contents.

In some embodiments, one or more flaps may be provided along the edge of one or other of the first and second panels in order to space the panels from one another when folded face to face to facilitate movement of the blister pack within the package.

The blister pack carrier is preferably made of a foldable sheet material, such as paperboard, cardboard or the like.

The present invention extends to a blank of foldable sheet material for providing the blister pack carrier of the present invention in any of its embodiments. The blank may comprise a first portion for providing the blister pack carrier and a second portion for providing the slider. The blank is preferably a single piece blank. The blank may comprise a first portion for providing the blister pack carrier, the first portion comprising; a first panel comprising one or more dispensing openings, each for receiving a blister of a blister pack; a second panel comprising one or more dispensing openings connected to said first panel along a foldline, with each of the one or more dispensing openings of the second panel being alignable with a said opening of the first panel when the first and second panels are arranged face to face; and a blocking member connected to a free edge of one of the first and second panels along a fold line. The blank may further comprise a second portion comprising an array of panels for providing the slider, wherein one of the first and second panels of the blister pack carrier is connected to one of the panels for providing the slider, preferably along a foldline.

In accordance with a further aspect, the invention provides a blank of foldable sheet material for forming a blister pack carrier and a slider comprising: a first portion for providing the blister pack carrier, the first portion comprising; a first panel comprising one or more dispensing openings, each for receiving a blister of a blister pack; a second panel comprising one or more dispensing openings connected to said first panel along a foldline, with each of the one or more dispensing openings of the second panel being alignable with a said opening of the first panel when the first and second panels are arranged face to face; and a blocking member connected to a free edge of one of the first and second panels along a fold line. The blank further comprising a second portion comprising an array of panels for providing the slider, wherein one of the first and second panels of the blister pack carrier is connected to one of the panels for providing the slider, preferably along a foldline. The blank is preferably a single piece blank.

In any of these further aspects of the invention, the first and second portions of the blank are preferably connected to one another along a foldline.

A fold line as referred to herein refers to any line about which components have been folded. The fold line may comprise a line of weakness, creaseline and/or perforations. If not explicitly stated, and unless inconsistent therewith, any connection described herein may be about a foldline.

The blister pack carrier, and where provided slider or container, are each made from a foldable sheet material such as paperboard, cardboard or other lightweight foldable sheet material. However, any suitable sheet material may be used, for example a plastics material. The container and slider, and, where applicable, blister pack carrier, may each comprise any suitable arrangement of construction flaps or other means to retain the respective parts in their dimensional states.

The present invention in accordance with any of its further aspects or embodiments may include any of the features described in reference to other aspects or embodiments of the invention to the extent it is not mutually inconsistent therewith.

BRIEF DESCRIPTION OF THE DRAWINGS

Some preferred embodiments of the invention will now be described by way of example only with reference to the accompanying drawings.

FIG. 9A illustrates an arrangement in which the slider of the package does not incorporate flaps 68, 70, and FIG. 9B illustrates an arrangement in which such flaps are provided.

DETAILED DESCRIPTION OF THE INVENTION

Figure 1:
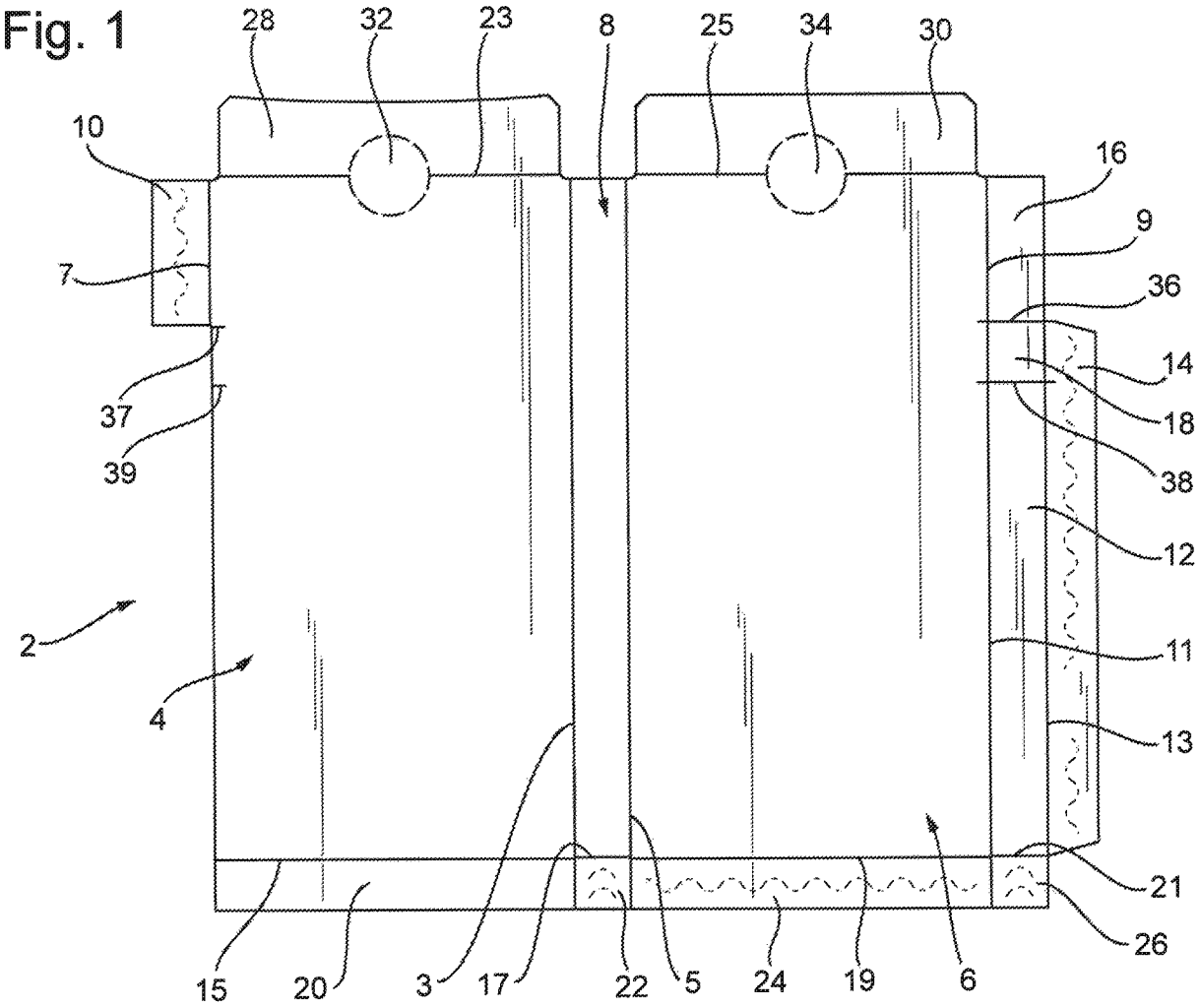
FIG. 1 shows a first blank for providing the container of a package in accordance with one embodiment of the invention.

With reference to FIG. 1, a blank 2 of paperboard or other foldable sheet material as known in the packaging art is shown that may be used to construct a container of a package in accordance with the invention. It will be appreciated that the wavy lines on certain glue flaps e.g. 10, 14 denote scoring which may optionally be applied to facilitate adhesion. FIG. 1 shows the blank from the top side in the flat which will form the exterior of the container. The blank 2 comprises a first panel 4 and a second panel 6 for providing facing panels of the container, and a third panel 8 for providing one side wall of the container. The first and second panels 4, 6 are connected via first and second fold lines 3, 5 to opposed side edges of the third panel 8. The blank also includes a glue flap 10 connected to the first panel 4 along a third foldline 7. A panel for providing the opposite side wall of the container has been slit along a cutline 36 to define a top flap 16 and a lower fourth panel 12. The cutline 36 extends into the second panel 6. The flap 16 and fourth panel 12 are connected along fourth and fifth fold lines 9, 11 to the second panel 6. A glue flap 14 is connected to the fourth panel 12 along a sixth foldline 13 along a side edge of the panel 12 opposite to that connected to the second panel 6. A further cutline 38 is provided extending across the entire width of the fourth panel 12, and into the second panel 6 and the flap 14. The cutlines 36 and 38 extend parallel to one another, and are spaced apart in the longitudinal direction.

The cutlines 36, 38 define an area 18 there between which will provide a release area of a locking feature of a package including the container. Third and fourth cutlines 37 and 39 are provided on the first panel 4 below the glue flap 10, which will provide a continuation of cutlines 36 and 38 when the blank is erected. In the embodiment shown in FIG. 1, the cutlines 36, 38 extend into the panel 6, and the cutline 38 also extends into the panel 14. It will be appreciated that while such arrangements are advantageous to facilitate operation of the release area, this is not essential, and the cutlines may be confined to the sidewall. Furthermore, the cutlines 36, 38 may not be straight, and may be e.g. curved, or of any other shape to provide a release area. Finally, it will be appreciated that only one cutline e.g. cutline 36 may be provided. It is also envisaged that a release area may be provided that is not defined by specific structural feature(s) of the container sidewall. For example, if the sidewall is made of a suitably flexible material, it may be deflected by the user without additional features e.g. cutlines to facilitate such deformation. In any arrangement, whether or not the release area is defined by structural features, a marking may be provided on the container or sidewall thereof indicative of how the release of the abutment may be effected and/or the position of the release area e.g. "press here".

The blank also includes a flap 20 for providing a bottom end wall of the container, and a set of construction flaps 22, 24, 26 for attachment to the flap 20. The flaps 20, 22, 24 and 26 are connected respectively to the first panel, third panel, second panel and fourth panel 12 along respective seventh, eighth, ninth and tenth fold lines 15, 17, 19 and 21. At the opposite end, which will define the top of the container, the blank includes flaps 28 and 30 connected along respective eleventh and twelfth fold lines 23, 25 to the first and second panels 4, 6. Perforations defining circular removable portions 32 and 34 are provided between the flaps 28 and 30 respectively and the first and second panels 4,6, in the central portion of the panels 4, 6 between their side edges. The portions 32 and 34 may be removed by a user to define thumb notches. It will be appreciated that any suitably shaped removable portions may be used that will define a thumb notch in the top edge of the panels 4,6 when removed as described below.

Foldlines 3, 5, 7 and 13 are all parallel to one another. Foldlines 9 and 11 are parallel to each of foldlines 3, 5, 7 and 13. Foldlines 15, 17, 19, 23 and 25 are also parallel to one another, and perpendicular to foldlines 3, 5, 7, 9, 11 and 13.

Erection of the container from the blank of FIG. 1 will now be described. For ease of reference, the surface of the blank, and the panel/flaps thereof visible in FIG. 1 will be referred to as the exterior surface thereof, with the opposite surface of the blank (and the panels/flaps thereof) being referred to as the interior surface. The blank is folded about the various fold lines. The exterior surface of flap 10 is glued to the interior surface of the flap 16. The exterior surface of flap 14 is glued to the interior surface of the first panel 4 along the side edge below flap 10. The exterior surfaces of flaps 22, 24, and 26 are glued to the interior surface of flap 20. The flaps 28, 30 are folded through 180 degrees onto the interior surfaces of first and second panels 4 and 6 respectively. Flap 30 is glued down on to the interior surface of panel 6, while flap 28 is left free.

Figure 2:
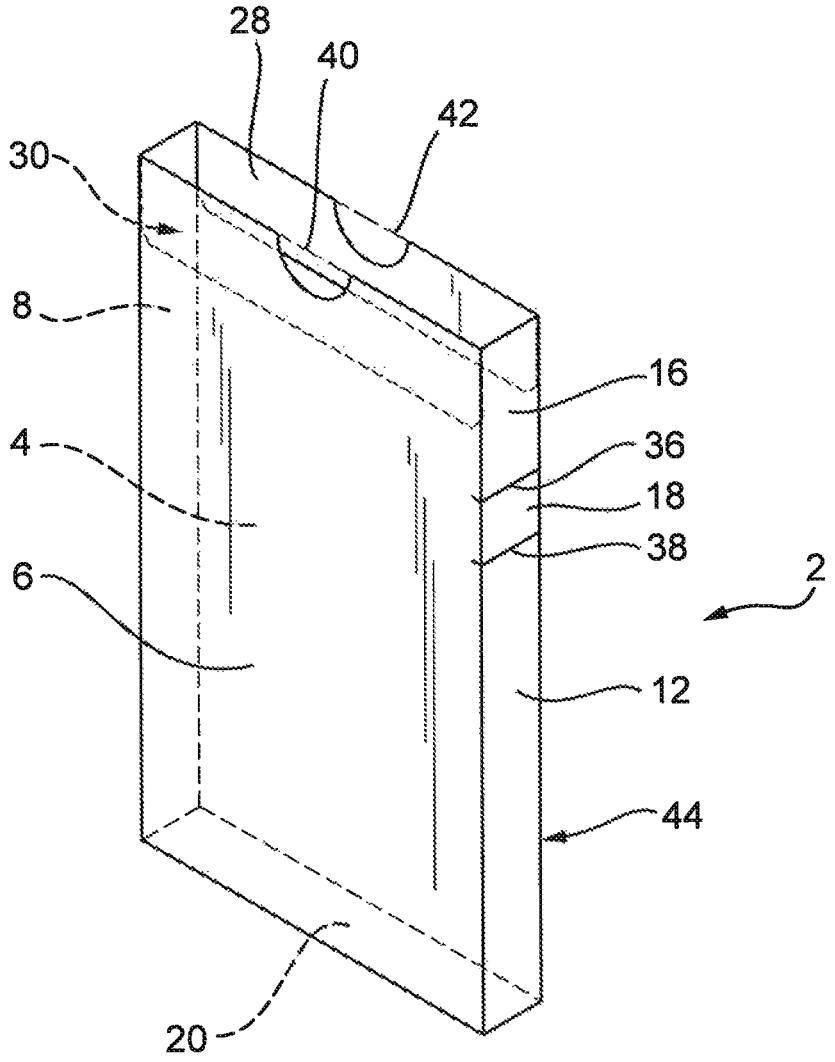
FIG. 2 shows the container obtained by erecting the blank of FIG. 1.

In this way a container 2 as illustrated in FIG. 2 is produced. The same reference numerals will be used to refer to the parts of the container corresponding to parts of the blank identified in relation to FIG. 1. The container 2 has a closed bottom end, defined by end wall 20 and an opposed open top end. The container has facing panels 4, 6, provided by the first and second panels of the blank, and side walls 44 and 46. Side wall 46 is provided by panel 8 of the blank. Side wall 44 is provided by top flap 16 and the lower fourth panel 12 of the blank. The sidewall 44 includes the cutlines 36 and 38 defining a release area 18 there between. The cutlines enable the release area to be depressed out of the plane of the sidewall toward the interior of the container. The cutlines 37, 39 provide a continuation of the cutlines 36, 38 on to the first panel 4 to further facilitate depression of the release area. At the open end of the container, the flaps 28 and 30 have been folded back against the interior of facing panels 4 and 6. In this way, the removable portions 32, 34 define semi-circular removable portions 42 and 40 respectively along the edges of the container defined by the folding of flaps 28 and 30. These portions 42, 40 may be removed by a user to define respective thumb notches along the top edges of the container to facilitate gripping of the slider therein and hence its withdrawal from the container. Rather than defining removable portions 32, 34 using perforations, in alternative arrangements the portions 32, 34 could be circular cutouts, to define semi-circular notches in the edges of the container directly when the flaps 28 and 30 are folded. However, it has been found that requiring the user to remove portions from the container in order to define the thumb notches provides an additional level of child resistance, helping to conceal the slider and provide a further barrier to its removal from the container. It will be appreciated that the shape of the thumb notches, and any removable portions used to define notches, may be selected as desired, and the shape need not be as in the particular example illustrated. The bottom edge of the glue flap 10 furthest from the open top end of the container provides a locking edge which may cooperate with a locking edge of the slider inserted in the container as described below.

A second blank for providing a slider and blister pack carrier for the package of the present invention will now be described by reference to FIG. 3, which shows the blank in the flat.

The blank 50 includes a first portion 54 which will provide a slider, and a second portion 56 connected thereto which will provide a carrier for a blister pack.

Referring to the portion of the blank for forming the slider, the blank includes a first panel 58 for forming a base of the slider, and second and third panels 60, 62, connected to respective side edges of the first panel 58 along first and second fold lines 59, 61, which will form the upstanding sidewalls of the slider. A flap 64 is connected to the third panel 62 along a third fold line 63 (here being a scoreline). A fourth panel 67 is connected to an end of the first panel 58 along a fourth fold line 65, and will form an end wall of the slider. A flap 66 is connected to an opposite end of the panel 58 along a fifth foldline 69 (here being a scoreline) Two tabs 68 and 70 extend from the side edges of the fourth panel 67, being connected thereto along sixth and seventh fold lines 71, 73, for purposes to be discussed below.

The first, second, third, sixth and seventh foldlines 59, 61, 63, 71, 73 are parallel to one another. The fourth and fifth foldlines 65, 69 are parallel to one another and perpendicular to the first, second, third, sixth and seventh fold lines.

Turning to the portion 56 of the blank that will provide the blister pack carrier, the blank includes a fourth panel 80 and a fifth panel 82 that will provide respective first and second panels of the blister pack carrier. The fourth panel 80 includes four elongate, parallel slots 84. The fifth panel 82 comprises four parallel rows of dispensing openings 81 aligned with the slots 84. The fourth panel 80 is connected to the fifth panel 82 along an eighth fold line 83 (here being a scoreline). Of course, a different number of slots may be provided in the fourth panel, with a corresponding number of rows of dispensing openings in the fifth panel 82. The arrangement with four slots, and four rows of dispensing openings is merely exemplary. Each of the openings 81 is covered by a removable cover, defined by perforations which must be removed by a user before the content of a blister may be dispensed. This provides additional child resistance. The shape of the removable cover may be selected as desired, and need not be circular as illustrated. The most appropriate shape may depend upon the shape of the content of the blister.

A generally trapezoidal blocking tab 86 is connected to a side edge of the fourth panel 80 via a connecting leg 88 at the end of the fourth panel 80 adjacent the foldline 83 connecting the panel to the fifth panel 82. The connecting leg 88 is connected to the side edge of the fourth panel via a ninth fold line 89. As will be illustrated below by reference to FIG. 10, in alternative embodiments a blocking panel may instead be connected to the free end edge of panel 80.

The fifth panel 82 is connected to the end wall 67 of the slider along a tenth foldline 85.

The fourth panel 80 comprises an arcuate cut line 90 which defines a tab. The cut 90 is positioned such that when the connecting leg 88 having the blocking tab 86 is folded about the foldline 89 connecting it to the side edge of the fourth panel 80, the tab defined by the arcuate cut 90 is generally aligned with the distal end of the blocking tab 86.

The fifth panel 82 is provided with an arcuate cut line 92 defining a tab which, when the fourth panel 80 is folded over the fifth panel 82 is also generally aligned with the blocking tab 86.

The eighth foldline 83 and the tenth foldline 85 are parallel to one another and to the fourth foldline 65. The ninth foldline 89 is parallel to the sixth and seventh foldlines 71, 73 and perpendicular to the eighth and tenth foldlines 83, 85.

Figure 5A:
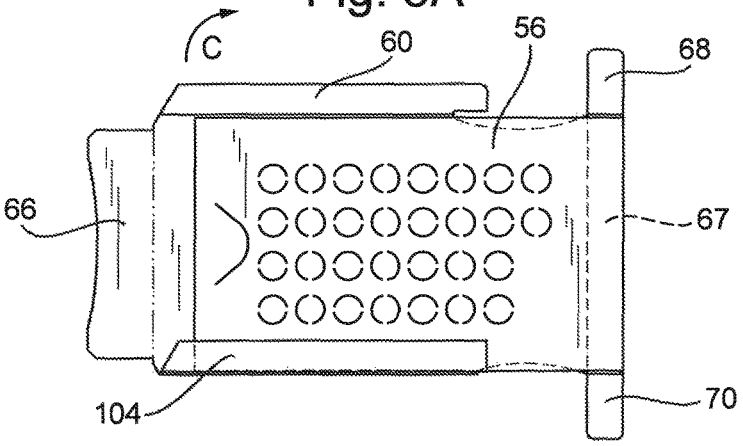
FIG. 5A illustrates the blister pack carrier obtained in a storage position within the slider.

Erection of a slider and blister pack carrier in accordance with one exemplary embodiment of the invention from the blank of FIG. 3 will now be described. The same reference numerals will be used to refer to the parts of the slider and blister pack carrier corresponding to parts of the blank identified in relation to FIG. 3. The erected slider is shown in FIG. 5A.

Figure 3:
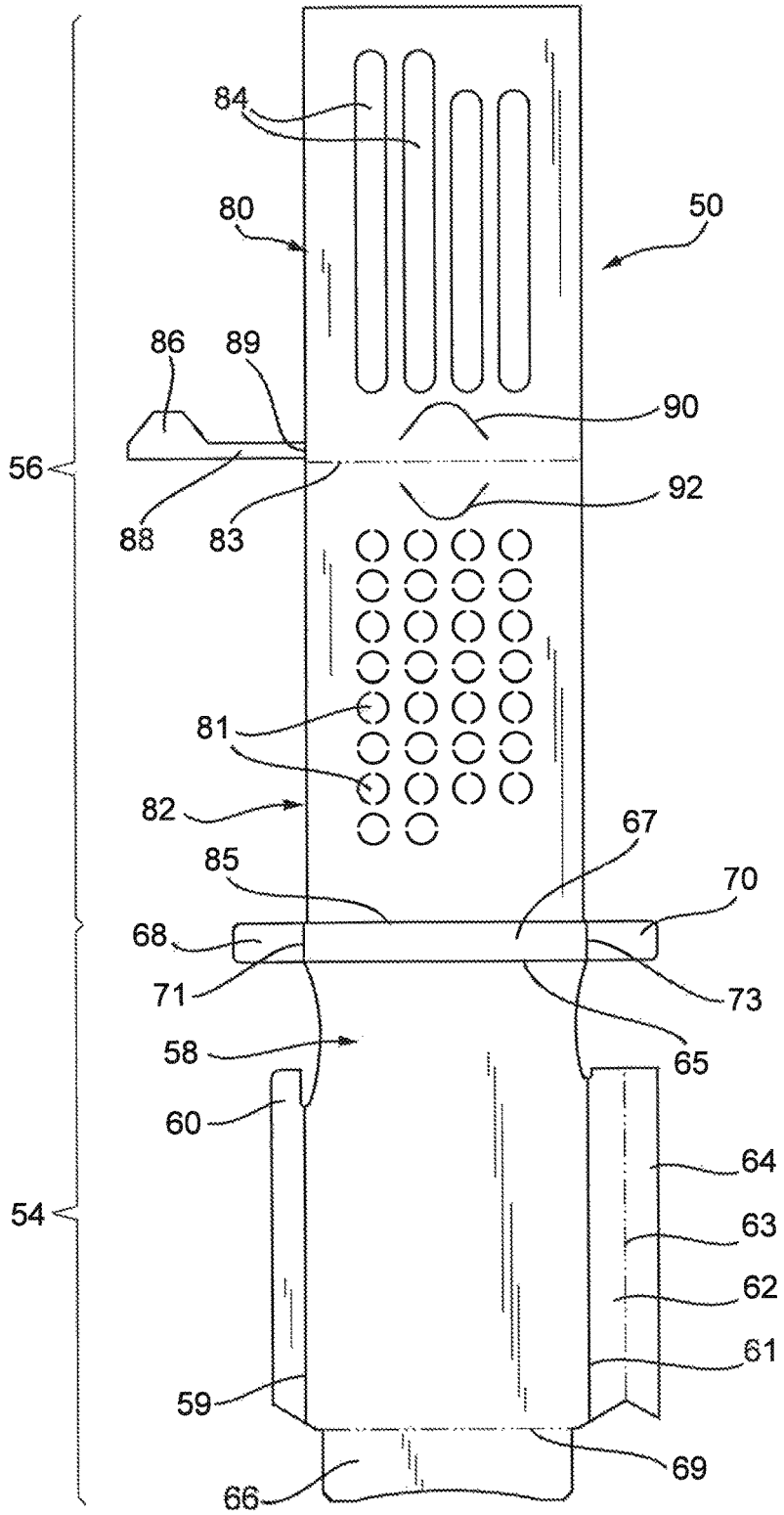
FIG. 3 shows a second blank for providing a slider and blister pack carrier of the package in accordance with one embodiment of the invention.

The view of the blank shown in FIG. 3 shows the surface of the blank that will form the interior surface of the slider when folded. References to the interior surface of the blank, or a component thereof, refer to the surface that is visible in FIG. 3. The exterior surface refers to the opposite surface thereof.

In one exemplary embodiment, the flap 64 is folded through 180 degrees and secured to the exterior surface of the third panel 62 using adhesive. This will provide a two ply sidewall 104 of the slider. Of course, such a two ply sidewall could alternatively be provided by joining a separate piece to the sidewall panel of the slider. Furthermore, it will be appreciated that the slider might only have a single sidewall, being that defining the locking edge.

The blister pack carrier is then constructed. Construction of the blister pack carrier will be described by reference to FIGS. 3 and 4A-D. FIGS. 4A-D omit the slider portion of the blank (connected to the end of panel 82 opposite to that connected via the foldline 83 to panel 80) for ease of illustration. The same reference numerals will be used to refer to the parts of the blister pack carrier corresponding to parts of the blank identified in relation to FIG. 3.

Figure 4A:
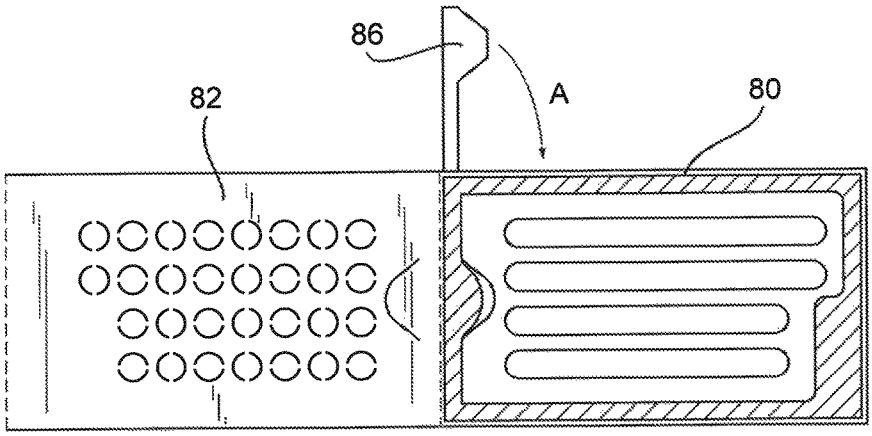
FIGS. 4A-D illustrate the steps involved in constructing the blister pack carrier from the blank of FIG. 3.
Figure 4B:
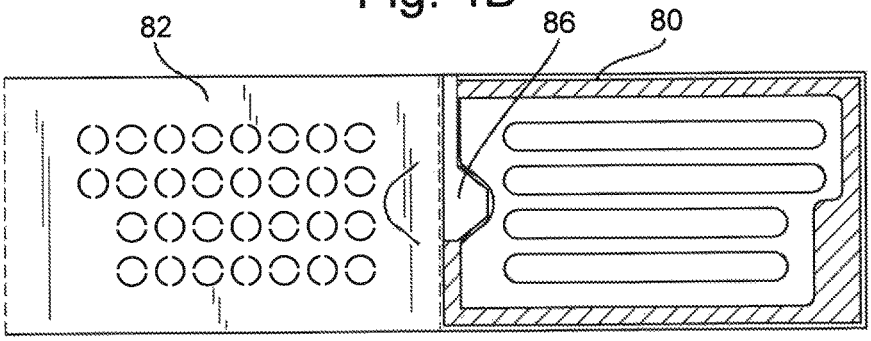

With reference to FIGS. 3 and 4A, glue is applied to the shaded region of the fourth panel 80. The blocking tab 86 is folded about the ninth foldline 89 connecting the connecting portion 88 to the side edge of the fourth panel 80 in the direction of the arrow A shown in FIG. 4A to a position in which the blocking tab 86 is aligned with the tab defined by the cut 90. This position is shown in FIG. 4B. The blocking tab 86 is secured in this position by the glue.

Figure 4C:
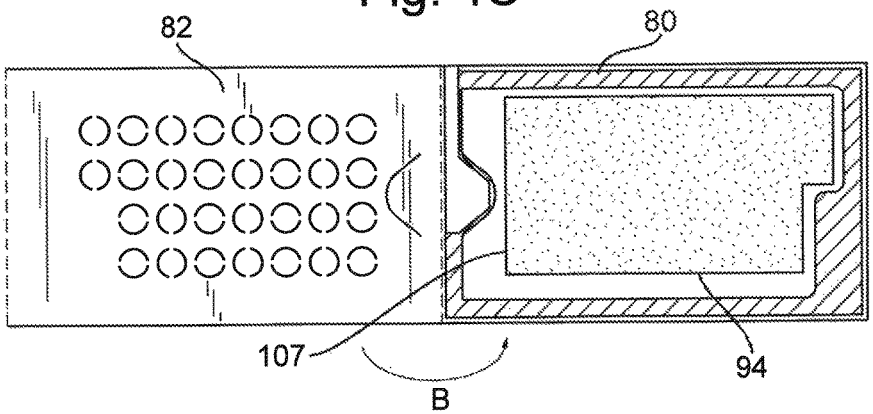

As shown in FIG. 4C, a blister pack 94 having four parallel rows of blisters, with 8, 8, 7 and 7 blisters therein respectively is positioned such that the blisters are located within the slots 84 of the fourth panel 80, with leading edge 107 of the blister pack 94 being spaced from the tip of the blocking tab 86. The blister pack is positioned within the region of the fourth panel that has not had glue applied thereto.

The fifth panel 82 is then folded about the eighth fold line 83 connecting it to the fourth panel 80 in the direction of the arrow B so as to overlie the surface of panel 80 and trap the blister pack 94 between the two panels 82, 84.

Of course, alternatively the fourth panel 80 may be folded over the fifth panel 82. In such cases, further steps may be needed to locate the blister pack on the second panel 82.

Figure 4D:
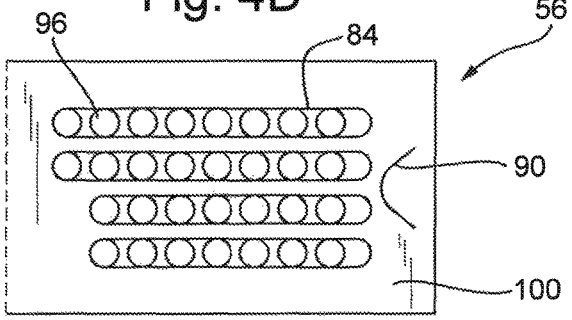

The resulting blister pack carrier 56 is shown in FIG. 4D. The blister pack carrier is shown from the side of the first panel 100 (corresponding to panel 80 of the blank), and which has the parallel slots 84. Blisters 96 of blister pack 94 located between the first panel 100 and a second panel 102 of the carrier (corresponding to panel 82 of the blank) are disposed in the slots 84.

The blister pack carrier 56 is then folded about the tenth foldline 85 so as to overlie the first panel 58 of the slider. The second and third panels 60, 62 of the slider are folded along the first and second foldlines 59, 61 connecting them to the first panel 58 to provide sidewalls of the slider, upstanding from a base provided by first panel 58. The flap 66 is folded toward the interior surface of the first panel 58 about fifth foldline 69. Of course, in alternative embodiments, the second and third panels 60, 62 of the slider may be folded along the first and second foldlines 59, 61 to provide upstanding walls before the blister pack carrier 56 is folded along foldline 85 to overlie the first panel 58 of the slider.

The blank 50 including the slider and blister pack carrier may be rotated one or more times during the above described erection steps to facilitate handling.

It will be appreciated that the order of steps in constructing the blister pack carrier and/or slider, and arranging the blister pack carrier relative to the slider may vary from the above described exemplary method, depending upon factors such as the techniques and configuration of adhesive used, and the configuration and orientation of the manufacturing line and its machinery etc.

Figure 5B:
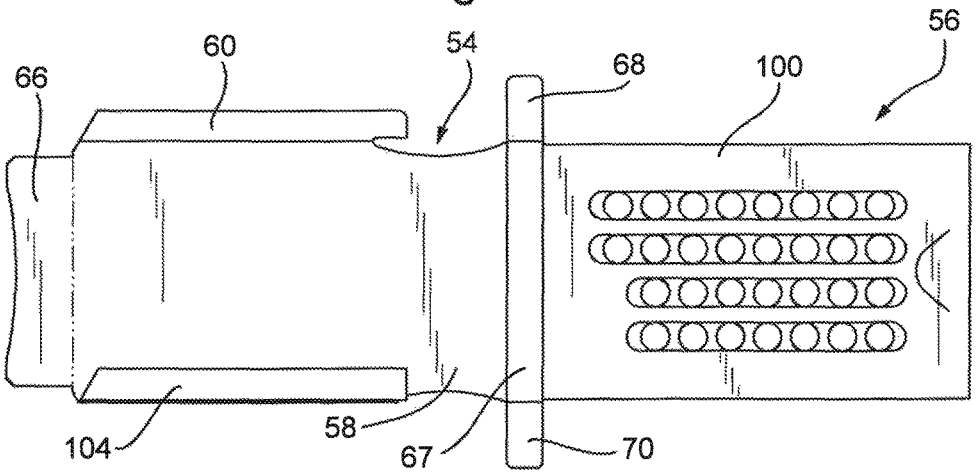
FIG. 5B illustrates the blister pack carrier after it has been moved into a position relative to the slider to permit access to the blisters.

FIG. 5A illustrates the erected blank shown in FIG. 3 with the assembled blister pack carrier 56 in a storage position within the interior space defined by the assembled slider 54. The blister pack carrier is movable in the direction of arrow C through up to 180 degrees, about the foldline 85 connecting it to the end wall 67 of the slider, to the position shown in FIG. 5B to provide access to the blister pack carrier for dispensing the contents of the blisters.

Assembly of the slider 54, with its integrally attached blister pack carrier 56, to the container 2 to provide a package in accordance with the invention will now be described.

The flap 66 of the slider is folded back about fifth foldline 69 toward the facing panel 58 before the slider is inserted in the container. The flaps 68, 70 are folded back about sixth and seventh foldlines 71, 73 toward the transverse ends of the sidewalls 60, 104. The slider is inserted into the container shown in FIG. 2 with the end having the flap 66 first (the first end of the slider). The second (or top) end of the slider is therefore that disposed furthest from the closed end of the container, and having the blister pack carrier connected thereto along the foldline 83. The slider is inserted fully into the container. In this position the transversely extending edge of the double ply sidewall 104 of the slider formed by panels 62 and 64 which is closest to the second end of the slider abuts the locking edge of the container provided by the edge of flap 10 furthest from the open end of the container. The abutment between the locking edges of the container and slider prevent the slider from being slid back out of the container until the abutment is released by a user. The end wall 67 of the slider closes the open end of the container in this position.

Figure 6:
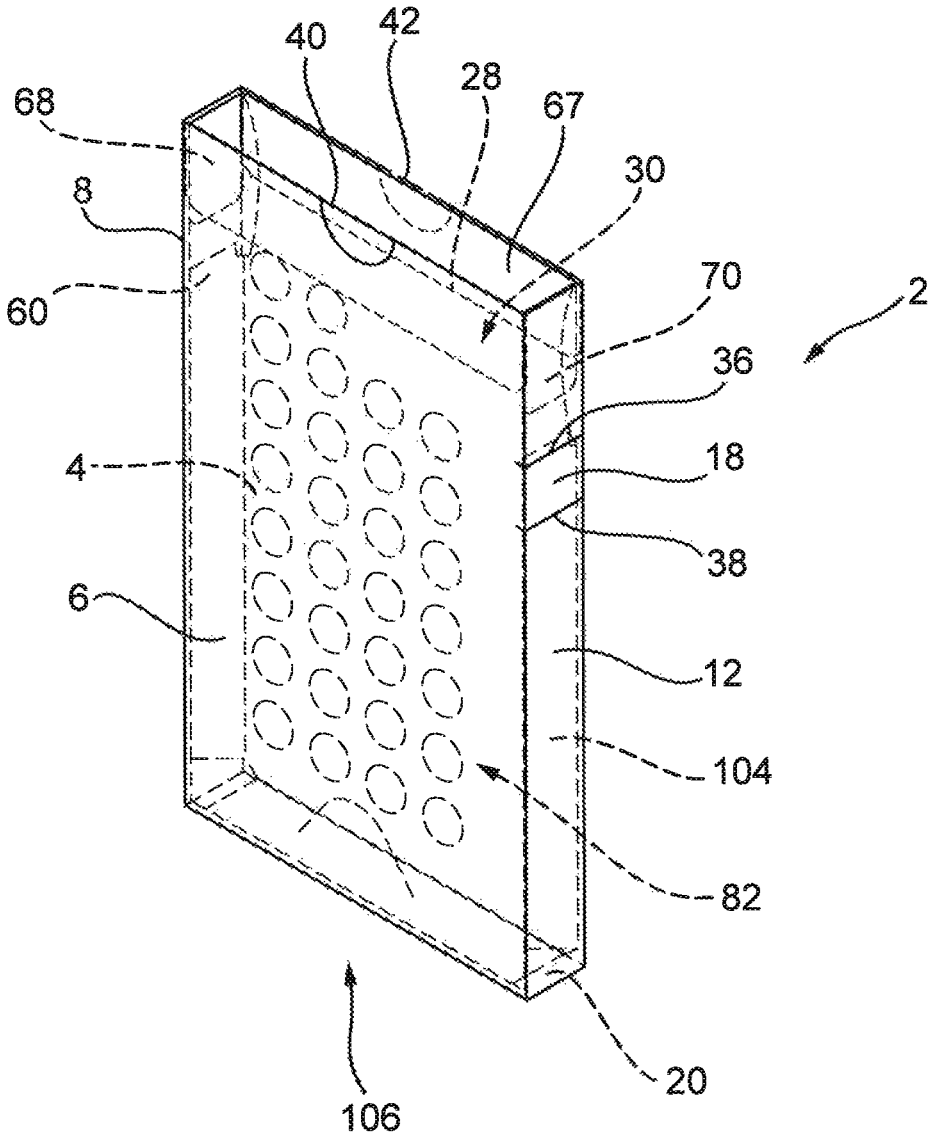
FIG. 6 illustrates a package in accordance with the invention formed by assembling the slider with its blister pack carrier shown in FIG. 5A and the container shown in FIG. 2.

FIG. 6 schematically illustrates the resulting package 106 formed from the slider 54 inserted in the container 2 of FIG. 2, with the blister pack carrier 56 in a storage position.

Figure 7A:
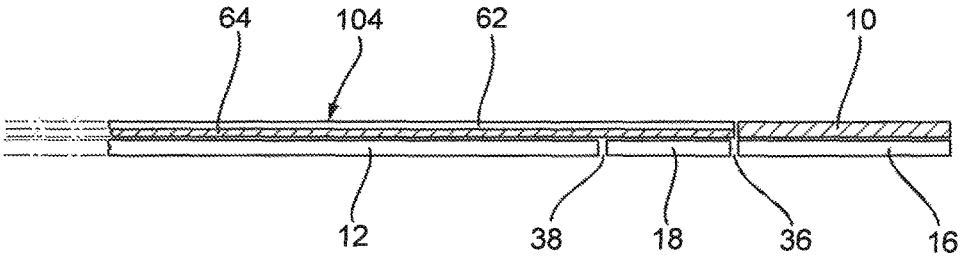
FIG. 7A illustrates a locking abutment between locking edges of the container and slider.
Figure 7B:
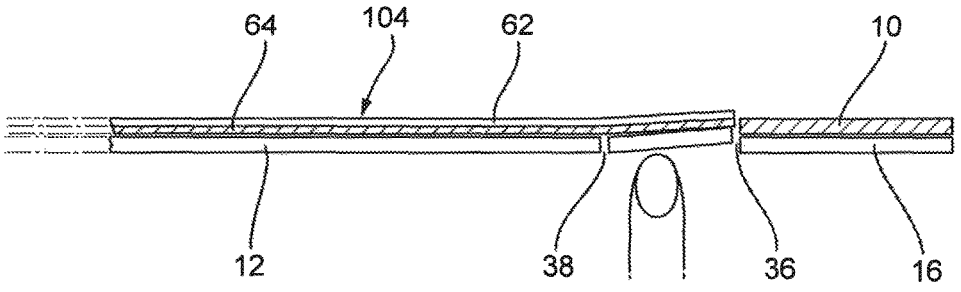
FIG. 7B illustrates the way in which the locking edge of the slider may be moved out of locking abutment with the locking edge of the container under manual pressure.

FIG. 7A is a schematic cross-sectional view of the side of the package showing the locking abutment between the transversely extending end edge of the double ply sidewall 104 made from panels 62 and 64 and the edge of flap 10. FIG. 7B illustrates how, when a user manually exerts pressure on the release area 18 to push it inwardly towards the interior of the package, the locking edge of the sidewall 104 may be deflected to allow it to ride past the locking edge provided by the flap 10. The flaps 68, 70 extending from the side edges of the end wall 67 of the slider have been omitted for clarity.

Operation of the Package Will Now be Described:

The package 106 is supplied to a user with the slider 54 inserted in the container 2, and the abutment between the locking edges of the slider and the container preventing the slider from being slid out of the open end of the container to allow access to the blister pack carrier. The user first removes the removable portions 40,42 to define thumb notches in the top edge of the container to facilitate gripping of the slider there through. In order to be able to slide the slider out of the sleeve, the user manually presses on the release area 18 as shown in FIG. 7B. This deflects the end of the sidewall 104 of the slider 54 having the locking edge at its distal end out of abutment with the locking edge of the container provided by the panel 10. The user may then, grasping the top of the slider through the thumb notches, slide the slider out of the container, with the sidewall 104 riding past the locking edge of the container. This provides an impediment to a child obtaining access to the blister pack and its carrier, as a particular set of actions must be performed, and a certain degree of pressure exerted on the release area of the container, in order to release the locking abutment. As the release area is defined between cutlines 36 and 38, it may be readily identified by a user, and a more precise area is provided that will deform under manual pressure.

The slider may be slid out of the container to reveal the blister pack carrier, which is in its storage position as shown in FIG. 5A. The slider is prevented from being completely separated from the container by virtue of engagement between the flaps 66 and 28. The user then folds the blister pack carrier 56 out of the slider by moving the free end of the blister pack carrier 56 in the direction of arrow C in FIG. 5A to the position in FIG. 5B.

Initially the blister pack is in a position in which the blisters are not aligned with the dispensing openings 81 in the panel 82. The user must overcome the blocking provided by the blocking tab 86 to be able to slide the blister pack relative to the first and second panels 80, 82 of the blister pack carrier to a position in which the blisters are aligned with the dispensing openings.

Figure 8A:
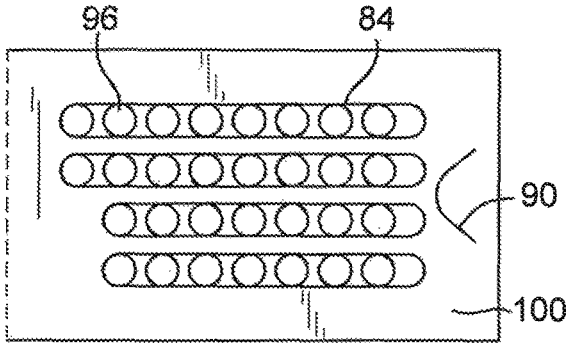
FIGS. 8A to 8D illustrate the steps involved in obtaining access to the contents of the blister pack held in the blister pack carrier.
Figure 8B:
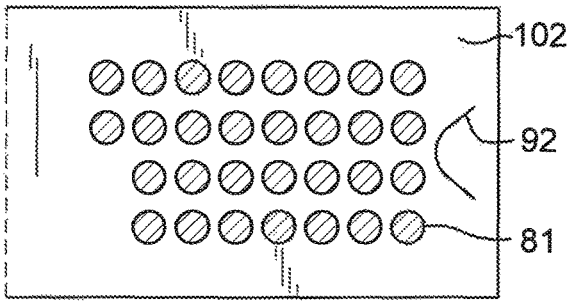

The operation of the blocking tab will be described by reference to FIGS. 8 A-D. FIG. 8A illustrates the blister pack carrier obtained following the steps shown in FIGS. 4A-D, and corresponds to FIG. 4D. FIG. 8B illustrates the carrier from the reverse side i.e. that of the second panel 102 having the dispensing openings 81.

In the view shown in FIGS. 8A and B, the blisters 96 are out of alignment with the respective dispensing openings 81 in the second panel 102 which means that the contents of the blisters 96 cannot be dispensed. Moreover, the blister pack cannot slide between the panels 100, 102 due to a leading edge 107 of the blister pack abutting the tip of the blocking tab.

Figure 8C:
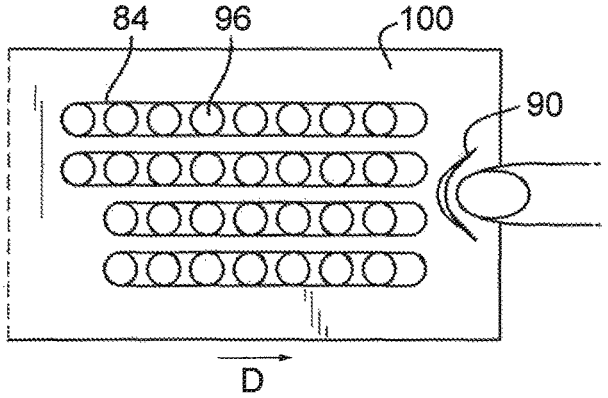
Figure 8D:
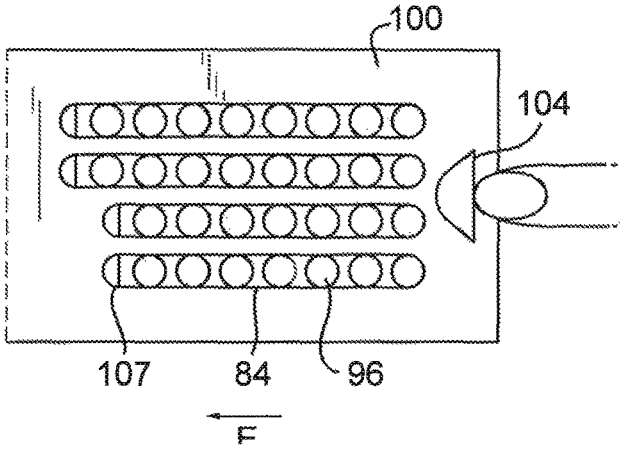

In order to dispense the contents of a blister 96, the tab defined in the first panel 100 by the cut line 90 is pushed inwardly as shown in FIG. 8C. This moves the blocking tab 86 out of alignment with the leading edge 107 of the blister pack 94, the blocking tab 86 being pushed out through cut line 92 in the second panel 102 of the carrier. The blister pack 94 may then be slid in the direction of arrow D in FIG. 8C such that its leading edge 104 rides up over the tab defined by cut 90 as shown in FIG. 8D. This allows the blisters 96 to align with the dispensing openings 81 in the second panel 102 whereupon the blister contents may be dispensed. The removable covers of the dispensing openings 81 in the second panel serve to conceal the blister pack 94 until they are removed, during or prior to dispensing. This provides additional child resistance, as a child may be less inclined to investigate the content of the blister pack carrier if they are unable to see the e.g. foil substrate of the blister pack. The blister pack 94 may then be slid in the opposite direction E as shown in FIG. 8D whereupon the blisters 96 move out of alignment with the dispensing openings 81 and the blocking tab 86 can be moved back into its blocking position under its inherent resilience or by being pushed back into position.

The blister pack carrier may then be returned to its storage position in the slider 54, and the slider 54 slid back into the container 2 until the locking edge of the slider 54 slides past the locking edge of the container 25. The locking edge of the slider 54 will then abut the locking edge of the container once more. The sidewall 104 having the locking edge of the slider 54 will tend to spring outwardly into the locking engagement due to the inherent resilience of the sidewall.

Figure 9A:
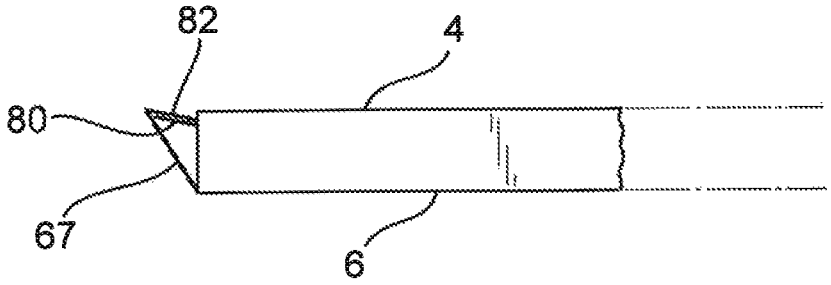
FIGS. 9A and 9B are side views in the vicinity of the top end of an assembled package, illustrating the operation of a further child resistant feature of the invention.
Figure 9B:
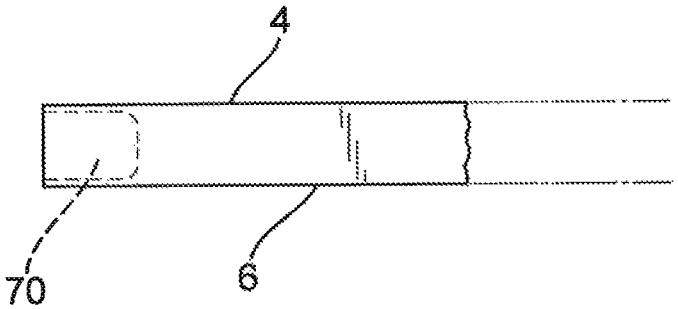

While the slider 54 is disposed within the container 2, the flaps 68, 70 prevent the end wall 67 of the slider 54 from rolling outwardly when a user tries to pull on the end of the slider through the notches defined in the container after removal of portions 40, 42. This provides a further child resistant feature. This effect is illustrated in FIGS. 9A and B. FIG. 9A shows a package in which the flaps 68, 70 are not provided. This is a side view in the vicinity of the top open end of the container, with the slider in its storage configuration, within the container. When a user grips the panels 58, 82 of the slider through the notches, the end wall 67 of the slider will tend to roll out of the open end of the container as shown in FIG. 9A, exposing the end of the blister pack carrier defined by panels 80, 82, and potentially providing access to, or facilitating access to blisters of the blister pack. By providing flaps 68, 70, and folding the flaps 68, 70 back toward the closed end of the container, with the flaps being located within the container when the slider is in its storage position as shown in FIG. 9B, this problem is avoided, as the flaps 68, 70 prevent outward rolling of the panel 67 from the open end of the container. FIG. 9B is a schematic side view of the package shown in FIG. 6 in the vicinity of the top end, with some feature of the locking means omitted for clarity. This is particularly useful in the context of a blister pack which includes only one layer of blisters, without a further layer of blisters provided which might interlock with the blisters to inhibit movement of the blister pack carrier and hence rolling out of the end wall 67.

Figure 10:
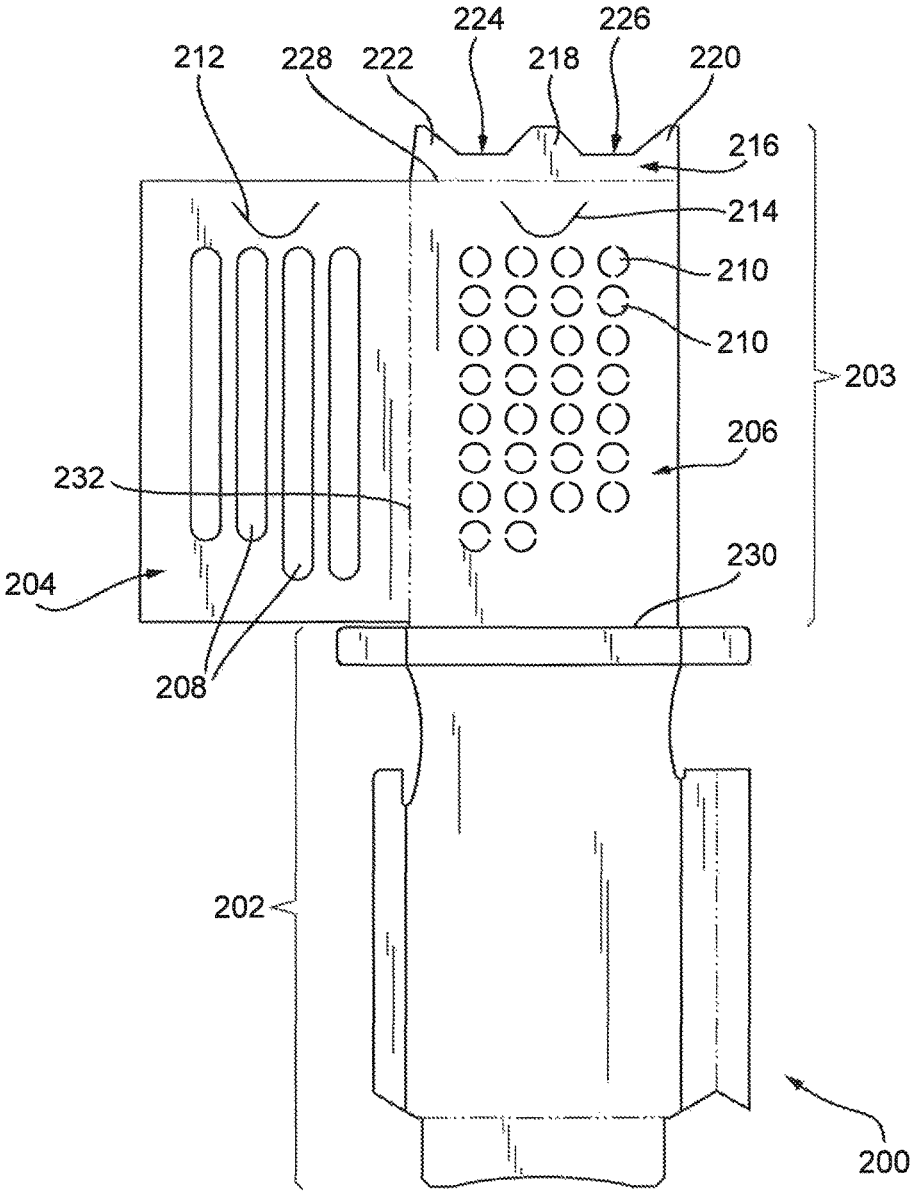
FIG. 10 illustrates a further blank for providing a slider and blister pack carrier of a package in accordance with another embodiment of the invention.

FIG. 10 illustrates an alternative blank 200 in the flat for providing a slider and blister pack carrier of a package in accordance with the present invention.

The blank 200 includes a first portion 202 which will provide a slider, and a second portion 203 connected thereto which will provide a carrier for a blister pack. The portion of the blank providing the slider is identical to the portion of the blank described above by reference to FIG. 3, and will not be further described.

Referring to the portion 203 of the blank that will provide the blister pack carrier, the blank includes a first panel 204 and a second panel 206 that will provide respective first and second panels of the blister pack carrier. The first panel 204 includes four elongate, parallel slots 208. The second panel 206 comprises four parallel rows of dispensing openings 210 (having removable covers) alignable with the slots 208 when the first panel is folded over the second panel. The first panel 204 is connected to the second panel 206 along a first foldline 232 (in the form of a scoreline).

A blocking device in the form of a blocking panel 216 is attached by its proximal edge to the end of the second panel 206 along a second foldline 228 (in the form of a scoreline), at an opposite end of the second panel to the end attached to the slider along third fold line 230. The blocking panel has a distal edge which defines a central peak 218 which provides a generally trapezoidal blocking tab. The central peak 218 is located between two valleys 224, 226, with further peaks 222, 220 being provided on either side of the valleys. It will be appreciated that the additional peaks 222, 220 may be omitted, depending upon particular requirements e.g. in terms of size/width and strength.

The first panel 204 comprises an arcuate cut line 212 which defines a tab. The cut 212 is positioned such that when blocking panel 216 having tab 218 is folded about the second foldline 228 connecting it to end edge of the second panel 206, the tab defined by the arcuate cut 212 is generally aligned with the distal end of the blocking tab 218. The second panel 206 is provided with an arcuate cut line 214 defining a tab which, when the first panel 204 is folded over the second panel 206 is also generally aligned with the blocking tab 218.

The second and third foldlines 228, 230 are parallel to one another. The first foldline 232 is perpendicular to the second and third foldlines 228, 230.

The first and second panels 204, 206 of the blister pack carrier in this further embodiment are therefore of the same construction as the first and second panels 80, 82 of the blister pack carrier of the earlier embodiment, but are connected to one another in a side by side configuration, rather than end to end. The blocking member differs from the earlier embodiment in that it is connected to a free end edge of a panel of the blister pack carrier, rather than a side edge thereof. A blocking member provided in this way may, in some situations, be easier to handle and glue in place than an elongate blocking member extending from a side edge of a blister pack carrier panel as shown in FIG. 3.

The blank may be constructed in the same manner as the earlier embodiment of FIG. 3. In one exemplary process, rather than assembling the blister pack carrier by folding the blocking member 86 along the foldline 89 over the first panel 80 and adhesively securing it thereto, and then folding the second panel 82 over the first panel 80 after location of the blister pack, in this further embodiment the blocking panel 216 is folded along the second foldline 228 over the second panel 206, and secured in place using adhesive applied to the peaks 218, 222, 220. The blister pack is located, and the second panel 206 folded along the first foldline 232 over the first panel 204 and adhesively secured thereto. The resulting blister pack carrier may then be folded about the third foldline 230 over the facing panel 58 of the slider in the same manner as the earlier embodiment. Of course, the sequence of steps may be varied as in the earlier embodiment.

Figure 11:
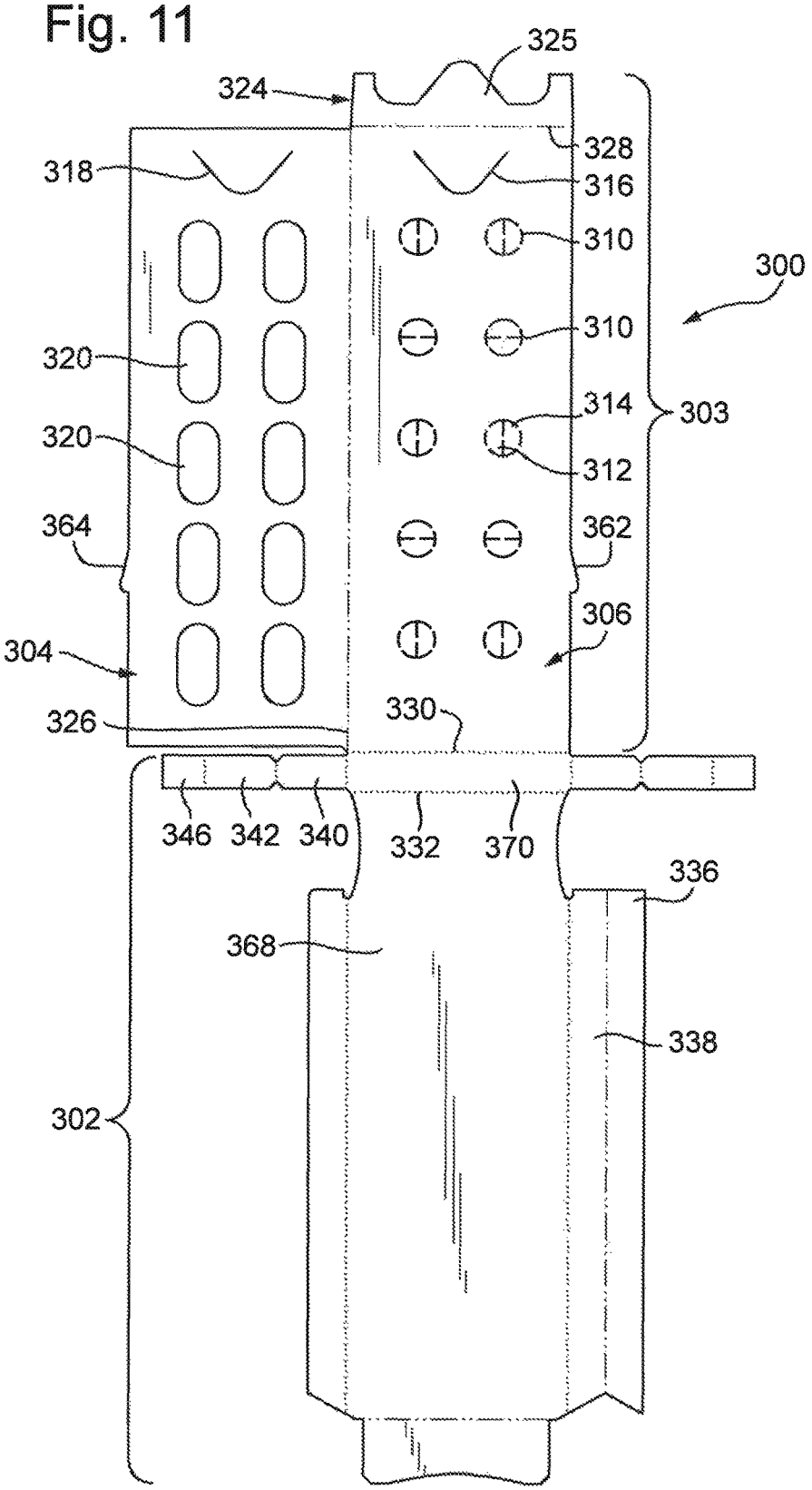
FIG. 11 illustrates a further blank for providing a slider and blister pack carrier of a package in accordance with another embodiment of the invention.

FIG. 11 illustrates an alternative blank 300 in the flat for providing a slider and blister pack carrier of a package in accordance with another embodiment of the present invention. The slider is used with a container in accordance with the earlier described embodiments i.e. as shown in FIG. 1. This Figure illustrates the blank as seen from the surface that will form the exterior of the slider and blister pack carrier in use. This embodiment includes a number of additional or alternative features, any or all of which may be incorporated in the earlier embodiment of the slider and blister pack carrier described by reference to FIGS. 3-10.

The blank 300 is similar to that shown in FIG. 10. The blank 300 includes a first portion 302 which will provide a slider, and a second portion 303 connected thereto which will provide a carrier for a blister pack.

Referring to the portion 303 of the blank that will provide the blister pack carrier, the blank includes a first panel 304 and a second panel 306 that will provide respective first and second panels of the blister pack carrier. The first panel 304 includes two parallel rows of slots 320. The second panel 306 comprises two parallel rows of dispensing openings 310. Each dispensing opening 310 is alignable with a respective one of the slots 320 when the first panel is folded over the second panel. The first panel 304 is connected to the second panel 306 along a first foldline 326 (in the form of a scoreline). It will be seen that, in contrast to the earlier described embodiments, each one of the slots 320 is of a length which may accommodate only a single blister in use, rather than a row of blisters. One slot 320 is provided in respect of each blister. It has been found that this may enhance child resistance, making it more difficult for a child to try to extract a blister pack via the slots in use. It will be appreciated that rather than using a slot of the length to accommodate an entire row of blisters as shown in the earlier embodiments e.g. of FIG. 3, or 10, these earlier embodiments may similarly employ shorter slots of a length to each accommodate a single blister in use.

A blocking device in the form of a blocking panel 324 having a central tab 325 is attached by its proximal edge to the end of the second panel 306 along a second foldline 328 (in the form of a scoreline), at an opposite end of the second panel to the end attached to the slider along third fold line 330. The blocking panel is of a similar shape to that shown in FIG. 10.

The first panel 304 comprises an arcuate cut line 318 which defines a tab. The cut 318 is positioned such that when blocking panel 324 having tab 325 is folded about the second foldline 328 connecting it to end edge of the second panel 306, the tab defined by the arcuate cut 318 is generally aligned with the distal end of the blocking tab 325. The second panel 306 is provided with an arcuate cut line 316 defining a tab which, when the first panel 304 is folded over the second panel 306 is also generally aligned with the blocking tab 325.

The second and third foldlines 328, 330 are parallel to one another. The first foldline 326 is perpendicular to the second and third foldlines 328,330. The end wall 370 is connected to a panel of the slider along the foldline 332 at an edge opposite that defined by foldline 330.

The embodiment of FIG. 11 also illustrates a preferred configuration for the removable covers covering the dispensing openings 310. Here, each cover comprises two semi-circular removable segments 312, 314, which are defined by perforations. The use of covers of this construction has been found to further increase child resistance, as the child must remove both segments of the cover before being able to access a blister of the underlying blister pack in use. This requires greater manual dexterity and persistence, reducing the likelihood that a child will successfully access an underlying blister. The covers provided for the dispensing openings of the invention in any of its other embodiments illustrated e.g. in FIG. 3, or 10 may similarly be provided by multiple removable segments in this way. Of course, the shape of the segments may differ from that illustrated, e.g. depending upon the intended shape of the dispensing openings, which in turn may depend upon the shape of the blister content.

The embodiment of FIG. 11 also differs from the earlier embodiments of FIGS. 3 and 10 in the portion 302 defining the slider. The only difference is in relation to the flaps extending from the side edge of the end wall 370 which prevent rollout of the end wall 370 of the slider. The other features of the slider are identical to those of the earlier embodiments of FIG. 3, or 10, and will not be described again. In contrast to the flaps 68, 70 of the FIG. 3 embodiment, in this further embodiment each flap is made up of an array of flap panels with a tab connected thereto. Referring to the array shown on the left, this includes a first flap panel 340, a second flap panel 342 and a tab 346. The array attached to the opposite side edge is of the same construction and will not be further described. The second flap panel 342 is folded back over the first flap panel 340 and secured thereto to provide a two ply flap. The tab 346 is secured to the interior of the end wall 370. The tab acts to reinforce the edge of the end wall 370. These features have been found to further enhance child resistance, and decrease the likelihood of roll out of the end wall 370 of the slider, and hence of a child obtaining access to the blister pack. The construction of a two ply flap using the array on the other side of the end wall is identical. The resulting slider has a pair of flaps extending from either side of the end wall 370 thereof as shown in FIG. 3 or FIG. 10, but each which flap is a two ply flap, and with added reinforcement of the end wall 370 toward the edges thereof.

It will be appreciated that the length of the tab associated with each flap may be increased if desired to provide additional reinforcement of the end wall 370. For example, the tabs may be increased in length so that the distal ends thereof abut one another at the center of the end wall 370 when secured thereto.

The blank 300 also includes a further feature associated with the blister pack carrier. The outer longitudinal side edges of the first panel 304 and the second panel 306 of the blister pack carrier includes respective projections 364, 362. When the first and second panels are secured to one another with the blister pack there between in assembly of the blister pack carrier, these projections 364, 362 will be joined in face to face contact, to provide a two ply projection on the side edge of the resulting blister pack carrier, closer to the second end of the slider. When the blister pack carrier is folded onto the slider facing panel 368, the projection will engage the double ply sidewall 104 of the slider formed from panels 336,338. When the slider is disposed in the container, the projection therefore biases the locking edge associated with the sidewall 104 into engagement with the locking edge of the container.

It will be appreciated that this embodiment of FIG. 11 therefore illustrates a number of preferred features; the slots 320 in the first panel 304 of the blister pack carrier having a length to accommodate a single blister, the segmented covers for dispensing openings 310, the biasing projection and the arrays for providing the two-ply anti-roll out flaps. Although the illustrated embodiment incorporates all of these features, it will be appreciated that any one or ones of these features may be omitted, or any combination thereof may be used. Similarly, any one or ones of these features may be incorporated in the earlier embodiments of FIGS. 3-10.

The blank of FIG. 11 may be constructed in the same manner as the earlier embodiments of FIGS. 3 and 10. Similarly, use will proceed in the same manner as described in the earlier embodiments.

It will be appreciated that various modifications to the above arrangements may be made within the scope of the invention. For example, the blocking panel may be attached to the second panel rather than the first panel as described. Moreover, there may be more or less dispensing openings and slots from that shown in the particular embodiments, depending on the nature of the blister pack being packaged. The shape of the dispensing openings, dispensing covers, and any segments defining dispensing covers, may differ from that illustrated, and may be selected as desired e.g. depending upon the shape of the intended blister content. Of course, openings may be provided in the first panel that are of a length shorter than the continuous slots shown e.g. in FIG. 3, but which are long enough to accommodate multiple blisters in contrast to those shown in FIG. 11. Further it should be understood that the various panels referred to herein may be formed from one or more sub panels. In addition it is envisaged that the slider and blister pack carrier might be provided using separate blanks attached to one another, rather than forming part of a single piece blank. The blister pack carrier may then be provided with an attachment panel to enable it to be attached to the slider. The blister pack carrier blank might then additionally include a panel to provide the end wall of the slider. It is also envisaged that the locking edge of the slider need not be double ply e.g. if a thick enough sidewall material is used.

What is claimed:

1. A carrier for a blister pack, the carrier comprising;

a first panel having an opening for movably receiving a blister of said blister pack;

a second panel having one or more dispensing openings aligned with said first panel opening, the first panel and the second panel slidably receiving the blister pack there between; and a blocking member selectively moveable back and forth between a blocking position and a dispensing position, said blocking member in its blocking position preventing sliding movement of said blister pack to position in which said blister in said first panel opening is in alignment with a said dispensing opening, thereby preventing dispensing a contents of said blister through the dispensing opening, and in said dispensing position permitting said blister pack to be moved to a position in which said blister is in alignment with a said dispensing opening for dispensing the blister's contents;

wherein the blocking member is connected to a free edge of one of the first and second panels about a fold line, and wherein one of the first and second panels of the blister pack carrier is connected to a panel of a slider.

2. The blister pack carrier of claim 1 wherein the blocking member is sandwiched between the first and second panels.

3. The blister pack carrier of claim 1 wherein the blocking member is a tab, wherein the tab is pushed out of the plane of the package to allow the blister pack to move.

4. The blister pack carrier of claim 1 wherein the free edge of the first or second panel is a side edge.

5. The blister pack carrier of claim 4 wherein the carrier comprises a blocking device connected to the side edge about a fold line, the blocking device comprising the blocking member and a connecting portion connecting the blocking member to the side edge.

6. The blister pack carrier of claim 1 wherein the free edge of the first or second panel is an end edge.

7. The blister pack carrier of claim 6 wherein the blister pack carrier comprises a blocking device connected to the end edge of one of the first and second panels thereof about a foldline, the blocking device having a proximal edge connected to the end edge of the first or second panel along the foldline, and an opposite distal edge defining a central peak providing the blocking member.

8. The blister pack carrier of claim 1 wherein the first and second panels of the blister pack carrier are connected to one another end to end along a fold line.

9. The blister pack carrier of claim 8 wherein the blocking member is connected to a side edge of the first or second panel of the blister pack carrier at an end of the first or the second panel which is connected to the other one of the first and second panels about the fold line.

10. The blister pack carrier of claim 1 wherein the first and second panels of the blister pack carrier are connected to one another side by side along a fold line.

11. The blister pack carrier of claim 1 wherein said one of the first and second panels of the blister pack carrier is connected to the panel of the slider along a foldline.

12. The blister pack carrier of claim 1 wherein said panel of the blister pack carrier is connected to the slider at an end of the slider.

13. The blister pack carrier of claim 1 wherein the slider and the blocking member are connected to the same one of the first or second panels of the blister pack carrier, wherein the slider is connected to the panel at an end opposite to an end at which the blocking member is provided.

14. The blister pack carrier of claim 1 wherein the blister pack carrier is movable relative to the facing panel of the slider about a foldline connecting the carrier to the slider between a storage configuration, in which the carrier faces the facing panel, and an open configuration for permitting access to the content of the blister pack.

15. The blister pack carrier of claim 1 wherein the slider further comprises a retaining flap for cooperating with a container within which the slider is slidably received in use to prevent complete separation of the slider and the container, the retaining flap being provided at an opposite end of the slider to the end which is connected to the panel of the blister pack carrier.

16. The blister pack carrier of claim 1 wherein the blister pack carrier and the slider are formed from portions of a single blank defining the slider and the blister pack carrier.

17. The blister pack carrier of claim 1 wherein the blister pack carrier and slider are made of a foldable sheet material, such as cardboard, paperboard or the like.

18. A package comprising a container and the slider having the blister pack carrier of claim 1 connected thereto slidably mounted within the container.

19. A blank of foldable sheet material for forming a blister pack carrier according to claim 1, and a slider therefor.

20. The blank of claim 19, wherein the blank is a single piece blank.

* * * * *